US005435693A

United States Patent [19]

Shaffer

[11] Patent Number: 5,435,693

[45] Date of Patent: Jul. 25, 1995

[54] PIN AND ROLLER ATTACHMENT SYSTEM FOR CERAMIC BLADES

[75] Inventor: James E. Shaffer, Maitland, Fla.

[73] Assignee: Solar Turbines Incorporated, San Diego, Calif.

[21] Appl. No.: 198,889

[22] Filed: Feb. 18, 1994

[51] Int. Cl.[6] ..... F04D 29/60

[52] U.S. Cl. ..... 416/204 A; 416/220 R

[58] Field of Search ..... 416/204 R, 204 A, 219 R, 416/220 R

[56] References Cited

U.S. PATENT DOCUMENTS

| | | | |
|---|---|---|---|
| 4,904,160 | 2/1990 | Partington | 416/220 R |
| 5,073,084 | 12/1991 | Hirst | 416/204 A |
| 5,368,444 | 11/1994 | Anderson | 416/220 R |

FOREIGN PATENT DOCUMENTS

| | | | |
|---|---|---|---|
| 745073 | 2/1956 | United Kingdom | 416/204 A |

*Primary Examiner*—John T. Kwon

*Attorney, Agent, or Firm*—Marshall, O'Toole, Gerstein, Murray & Borun

[57] ABSTRACT

In a turbine, a plurality of blades are attached to a turbine wheel by way of a plurality of joints which form a rolling contact between the blades and the turbine wheel. Each joint includes a pin and a pair of rollers to provide rolling contact between the pin and an adjacent pair of blades. Because of this rolling contact, high stress scuffing between the blades and the turbine wheel reduced, thereby inhibiting catastrophic failure of the blade joints.

25 Claims, 2 Drawing Sheets

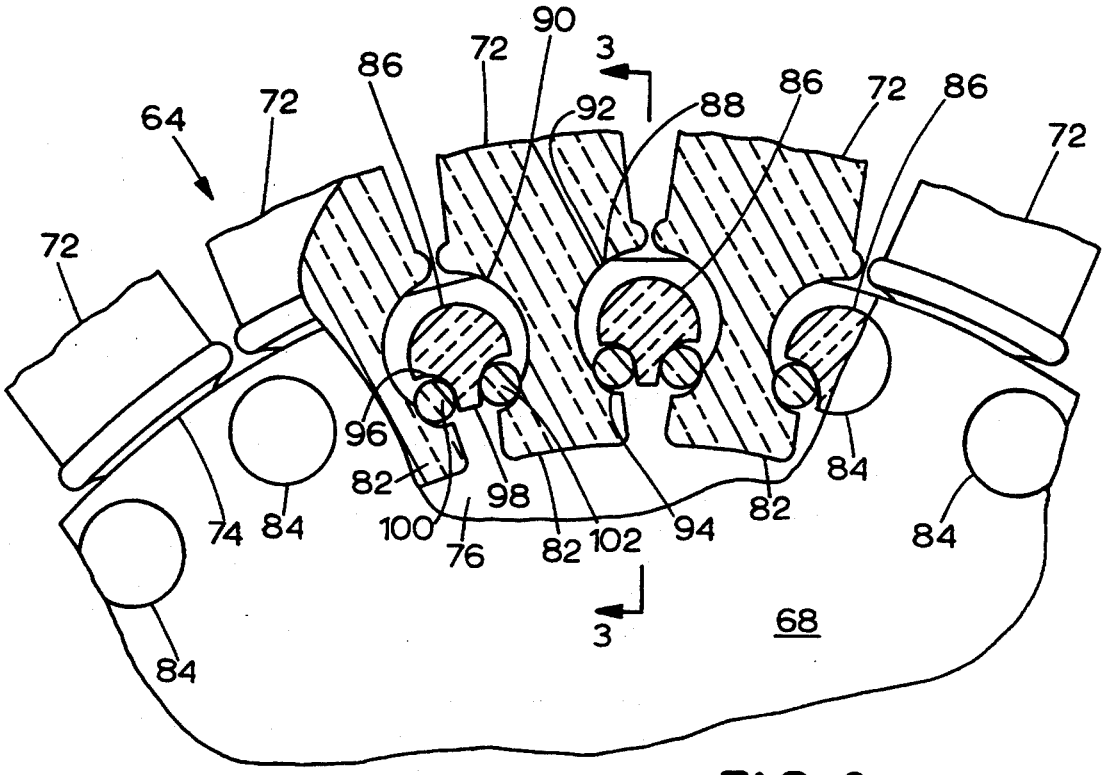
FIG. 2
FIG. 3
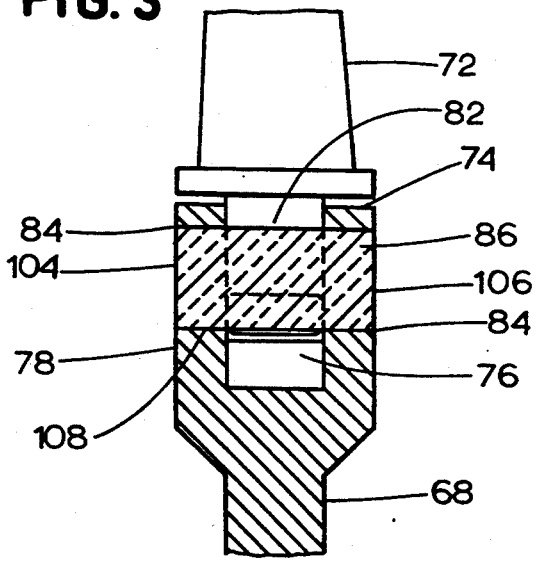

PIN AND ROLLER ATTACHMENT SYSTEM FOR CERAMIC BLADES

"The Government of the United States of America has rights in this invention pursuant to contract number DE-AC02-92CE40960 awarded by the United States Department of Energy."

TECHNICAL FIELD

The present invention relates generally to a gas turbine engine, and more particularly to a turbine wheel assembly for a gas turbine engine wherein the turbine wheel assembly includes a plurality of blades attached to a turbine wheel.

BACKGROUND ART

A typical gas turbine engine, such as an axial flow gas turbine engine, includes a compressor section, a turbine section, and a combustor section. The combustor section is located between the compressor section and the turbine section. Air at atmospheric pressure is initially compressed by the compressor section, and the resulting compressed air is delivered to the combustor section. In the combustor section, heat is added to the compressed air leaving the compressor section by mixing fuel with the compressed air and by burning the resulting fuel/air mixture. The high temperature gas flow resulting from the combustion of the fuel/air mixture in the combustor section expands through the turbine section, and some of the energy of this high temperature gas flow is used to drive the turbine section in order to produce mechanical power.

A turbine section may have one or more stages, wherein each stage employs one row of stationary nozzle guide vanes and a corresponding row of blades. Each row of blades is mounted on a corresponding rotatable turbine wheel. A turbine wheel, for example, may be in the form of a disk. The nozzle guide vanes are aerodynamically designed to direct incoming gas from the combustor section onto the turbine blades to thereby aerodynamically transfer kinetic energy to the blades causing rotation of the turbine wheel.

In the past, the high temperature combustion gases entering the turbine section typically have had a gas entry temperature in the range of 850° F. to at least 1200° F. Since the efficiency and work output of the gas turbine engine are related to the gas entry temperature of the incoming high temperature combustion gases, there is a trend in gas turbine engine technology to increase the gas entry temperature. A consequence of increasing the gas entry temperature of the combustion gases in a gas turbine engine is that the materials of the nozzle guide vanes and blades must be chosen so that the nozzle guide vanes and blades can resist such increased gas entry temperatures.

Historically, nozzle guide vanes and blades have been made of metals, such as high temperature steels, and, more recently, such as nickel alloys. Even with these types of high temperature materials, it has been found necessary to provide internal cooling passages in order to prevent melting of these materials. Also, ceramic coatings can be applied to the nozzle guide vanes and blades to further enhance the heat resistance of such nozzle guide vanes and blades. In specialized applications, nozzle guide vanes and blades are being made entirely of ceramic, which resists even higher gas entry temperatures.

However, if the nozzle guide vanes and/or blades are made of ceramic, which has a different chemical composition, physical property, and coefficient of thermal expansion to that of their corresponding metal supporting structures, then undesirable stresses, a portion of which are thermal stresses, will result between the nozzle guide vanes and/or blades and their metal supporting structures when the gas turbine engine is operating. Such undesirable thermal stresses cannot effectively be contained by cooling.

Conventional joints between the blades and turbine wheels of a turbine section have typically used a fir tree, or a dove tail, root design. Historically, a dove tail root design has been used with a ceramic blade in order to attach the ceramic blade to a metal turbine wheel. A metal compliant layer is used between the highly stressed ceramic blade root and the metal turbine wheel in order to accommodate relative movement therebetween and any sliding friction which may occur as a result of this relative movement. Sliding friction between the ceramic blade and the metal turbine wheel creates a compact tensile stress on the ceramic blade that degrades the ceramic surface of the ceramic blade. This degradation in the ceramic surface of the ceramic blade occurs in a tensile stress zone of the blade root. Therefore, if a surface flaw is generated in the ceramic surface of critical size, the blade root fails catastrophically.

The present invention overcomes one or more of the problems as set forth above.

DISCLOSURE OF THE INVENTION

In accordance with one aspect of the present invention, a turbine assembly comprises an annular turbine wheel, a plurality of blades, a plurality of pins, and a plurality of rollers. The annular turbine wheel has a preestablished rate of thermal expansion, an outer perimeter, and a groove therein. The groove extends into the outer perimeter of the annular turbine wheel so as to form first and second end walls defining the groove. The first and second end walls have axially aligned holes therethrough. Each of the plurality of blades has a preestablished rate of thermal expansion which is less than the preestablished rate of thermal expansion of the annular turbine wheel, and has a root portion extending into the groove. The root portion of each blade has first and second opposing generally arcuate faces. Each of the plurality of pins has a preestablished rate of thermal expansion which is substantially equal to the preestablished rate of thermal expansion of the plurality of blades. The pins have grooves along surfaces thereof, and each pin extends through a corresponding pair of axially aligned holes. Each of the plurality of rollers has a preestablished rate of thermal expansion which is substantially equal to the preestablished rate of thermal expansion of the plurality of blades. Each roller is positioned in a corresponding groove of a corresponding pin so that the pins and rollers retain the plurality of blades on the annular turbine wheel and so as to provide a rolling contact between the generally arcuate faces of the plurality of blades and the plurality of pins.

In accordance with another aspect of the present invention, a turbine assembly comprises a metal turbine wheel, a plurality of ceramic blades, a plurality of ceramic pins, and a plurality of ceramic rollers. Each ceramic blade has first and second ends, and each second end has first and second opposing arcuate faces. Each ceramic pin has a pair of grooves along a surface thereof. Each ceramic roller is positioned in a corresponding groove of a corresponding ceramic pin so that the plurality of ceramic rollers and the plurality of ceramic pins retain the plurality of ceramic blades attached to the metal turbine wheel and so that a rolling contact is provided between the arcuate faces of the second ends of the plurality of ceramic blades and the plurality of ceramic pins.

In accordance with yet another aspect of the present invention, a turbine assembly includes a turbine wheel, a plurality of blades each of which has first and second ends, and an attaching means for attaching the plurality of blades to the turbine wheel so as to provide a rolling contact between the plurality of blades and the turbine wheel. The attaching means includes a plurality of pins and a plurality of generally cylindrical rollers. Each of the generally cylindrical rollers provides a rolling contact between a corresponding blade and a corresponding pin.

BRIEF DESCRIPTION OF THE DRAWINGS

These and other features and advantages will become more apparent from the following detailed description of the invention when taken in conjunction with the drawings in which:

FIG. 2 is an enlarged, partial sectional view of a portion of FIG. 1 taken along line 2—2 of FIG. 1; and, FIG. 3 is a partial sectional view of a joint between a ceramic blade and a turbine wheel taken along line 3—3 of FIG. 2.

BEST MODE FOR CARRYING OUT THE INVENTION

Figure 1:
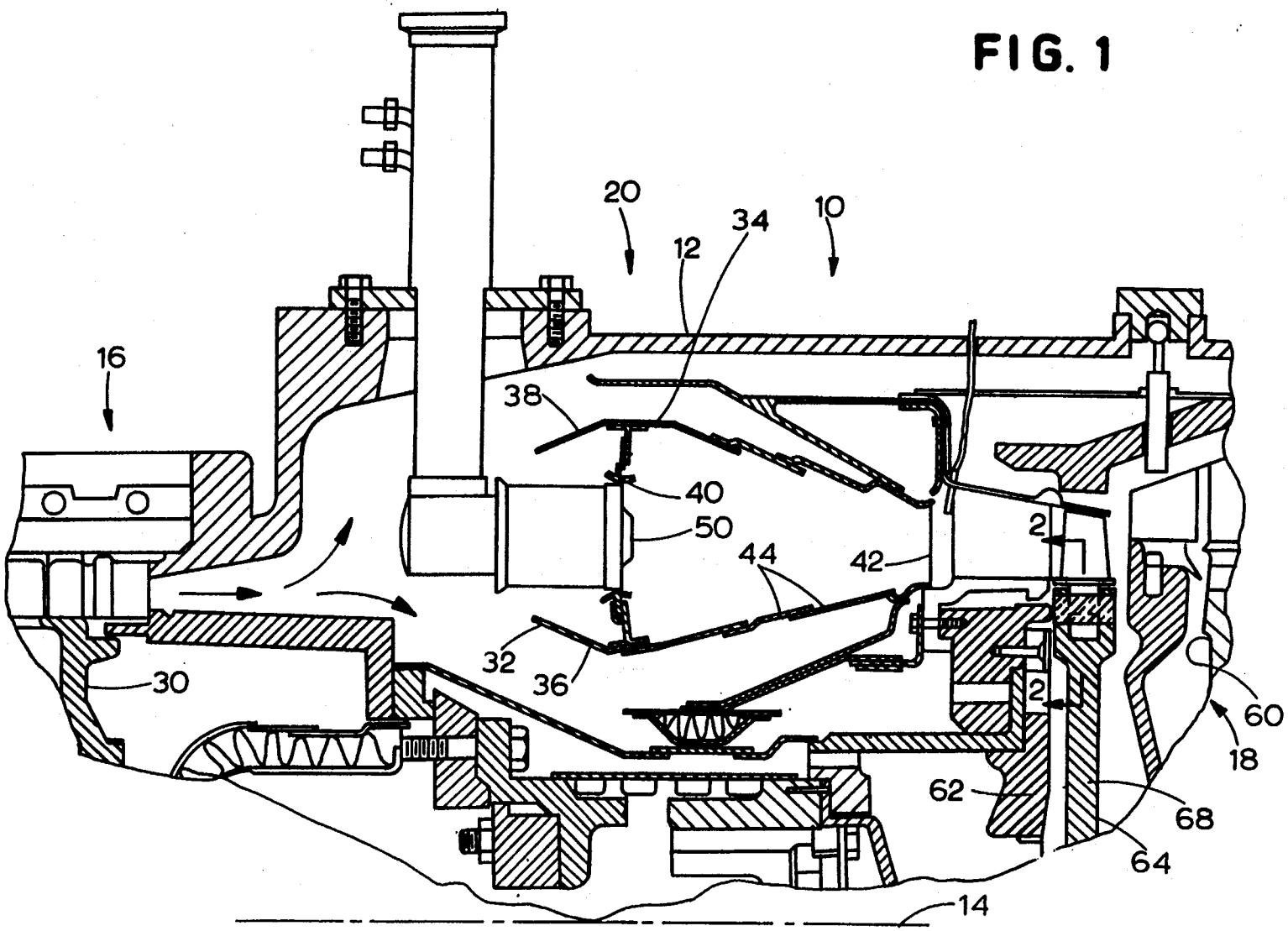
FIG. 1 is a partial sectional side view of a gas turbine engine embodying the present invention.

As shown in FIG. 1, a gas turbine engine 10 has an outer housing 12 and a central axis 14. Positioned within the outer housing 12 and centered about the central axis 14 is a compressor section 16, a turbine section 18, and a combustor section 20. The combustor section 20 is positioned operatively between the compressor section 16 and the turbine section 18.

When the gas turbine engine 10 is in operation, the compressor section 16 causes a flow of compressed air. At least part of this compressed air is communicated to the combustor section 20. The compressor section 16 may include an axial stage compressor 30 but may, as an alternative, include a radial compressor or any other source for producing compressed air. The combustor section 20 includes an annular combustor 32. The annular combustor 32 has a generally cylindrical outer shell 34 and a generally cylindrical inner shell 36 which are positioned coaxially about the central axis 14. An inlet end 38 of the annular combustor 32 has a plurality of generally evenly spaced openings 40 therein. The annular combustor 32 also has an outlet end 42.

In the arrangement of the gas turbine engine 10 shown in FIG. 1, the annular combustor 32 may be, if desired, constructed of a plurality of generally conical segments 44. Each of the generally evenly spaced openings 40 has an injector 50 positioned therein. As an alternative to the annular combustor 32, the combustor section 20 may include a plurality of can-type combustors.

The turbine section 18 includes a power turbine 60 having an output shaft (not shown) connected thereto for driving an accessory component, such as a generator. Another portion of the turbine section 18 includes a gas producer turbine 62 connected in driving relationship to the compressor section 16.

As shown in FIGS. 1, 2, and 3, the gas producer turbine 62 includes a turbine wheel assembly 64 rotationally positioned about a hub (not shown) which is centered about the central axis 14. The turbine wheel assembly 64 includes a turbine wheel 68, which may be in the form of a disk and which is suitably attached to the hub. The turbine wheel 68 may be metal. The turbine wheel assembly 64 also includes a plurality of blades 72 distributed around an outer perimeter 74 of the turbine wheel 68. The blades may be ceramic.

As best shown in FIG. 3, the turbine wheel 68 has a groove 76 recessed into the turbine wheel 68 through the outer perimeter 74 thereof. The groove 76 may be annular, may be continuous around the perimeter 74 of the turbine wheel 68, and may form a first end wall 78 and a second end wall 80 around the outer perimeter 74 of the turbine wheel 68 such that the first end wall 78 and the second end wall 80 of the turbine wheel 68 have the groove 76 therebetween. Each of the plurality of blades 72 has a root 82 which extends into the groove 76.

Each of the first and second end walls 78 and 80 has a plurality of holes 84 such that each of the holes 84 in the first end wall 78 axially aligns with a corresponding hole 84 in the second end wall 80. Each of a plurality of pins 86 extends through a corresponding pair of axially aligned holes 84. Although the pins 86 may have any suitable shape, the pins 86 are preferably generally cylindrical. The pins 86 are preferably ceramic.

As best shown in FIG. 2, each root 82 of the plurality of blades 72 has a first generally arcuate face 88 and a second generally arcuate face 90. The first and second generally arcuate faces 88 and 90 form corresponding recesses. Each of the pins 86 is located between opposing generally arcuate faces of two adjacent blades so that the root 82 of each blade 72 partially surrounds a pair of pins 86 with one pin 86 on each side of the root 82 of each of the blades 72. The first generally arcuate face 88 of each root 82 has a first face portion 92 and a second face portion 94. The first face portion 92 of each root 82 has a radius which is greater than the radius of the second face portion 94 of each root 82. Similarly, the second generally arcuate face 90 of each root 82 has first and second face portions wherein the first face portion of the second generally arcuate face 90 of each root 82 has a radius which is greater than the radius of the second face portion of the second generally arcuate face 90 of each root 82.

As shown in FIG. 2, each of the pins 86 has a generally arcuate first groove 96 and a generally arcuate second groove 98. A first roller 100 is positioned between each generally arcuate first groove 96 of each pin 86 and the second face portion 94 of one of an adjacent pair of blades 72. A second roller 102 is positioned between each generally arcuate second groove 98 of each pin 86 and the second face portion 94 of the other one of an adjacent pair of blades 72. The first and second rollers 100 and 102 are preferably ceramic.

Thus, as shown, the pins 86 and the first and second rollers 100 and 102 of each of the pins 86 are arranged to provide a rolling contact with the roots 82 of the blades 72 so as to attach the plurality of blades 72 to the turbine wheel 68. Because of this rolling contact, brinelling of the roots 82 and of the pins 86 is avoided. That is, without this rolling contact, indentations may be formed in the roots 82 and in the pins 86 due to the pressure on these elements during operation of the gas turbine engine 10. If such indentations are formed, failure of the turbine wheel assembly 64 could result.

As shown in FIG. 3, each of the pins 86 has a first end 104 and a second end 106. The generally arcuate first and second grooves 96 and 98 in a cylindrical surface 108 of each pin 86 do not extend entirely between the first and second ends 104 and 106 of the pins 86. Accordingly, the first and second rollers 100 and 102 are captured within the generally arcuate first and second grooves 96 and 98 of the pins 86 and between the pins 86 and the second face portions 94 of the roots 82 of the blades 72.

INDUSTRIAL APPLICABILITY

In use, the gas turbine engine 10 is started and allowed to warm up, and is used in any suitable power application. As the demand for load or power increases, the output of the gas turbine engine 10 is increased by increasing the supply of fuel and subsequent air to the combustor section 20. As a result, the temperature within the gas turbine engine 10 increases. The aerodynamic forces produced by the combustion gases of the combustor section 20 are transferred to the turbine wheel 68 by the blades 72. The aerodynamic forces on the blades 72 cause rotation of the turbine wheel 68 in order to provide power to auxiliary equipment such as the compressor section 16 of the gas turbine engine 10.

As the temperature of the gas turbine engine 10 increases, conventional dove tail root sockets in the conventional turbine wheel grow apart from the blade dove tail roots to which the blades are attached, which allows these dove tail roots to slide farther and farther out of the conventional dove tail root sockets. As the dove tail roots migrate outwardly, any flaws in the surface of these dove tail roots can be easily overstressed due to the nature of the brittle materials of the turbine wheel assembly. This overstressing can lead to catastrophic failure of the dove tail root. However, because of the rolling contact between the pins 86 and the turbine wheel 68 provided by the first and second rollers 100 and 102 of the present invention, only minimal stress is experienced by the roots 82.

Accordingly, as the turbine wheel assembly 64 rotates in reaction to the aerodynamic forces applied to the blades attached to the turbine wheel of the turbine wheel assembly, centrifugal forces cause the individual blades 72 to exert an outwardly directed force through the first and second rollers 100 and 102 on the pins 86. In reaction to this force, the pins 86 exert an inwardly directed force through the first and second rollers 100 and 102 on the roots 82 of the blades 72 to retain the blades 72 attached to the turbine wheel 68. The first and second rollers 100 and 102 are, accordingly, pinched between the second face portions 94 of the roots 82 and their corresponding pins 86. Because of the use of the generally cylindrical first and second rollers 100 and 102 between the generally arcuate first and second grooves 96 and 98 and the generally arcuate second face portions 94 of the roots 82 of adjacent pairs of blades 72, scuffing between the roots 82 of the blades 72 and the pins 86 is substantially reduced or eliminated thus increasing the life of the blades 72.

That is, the interfaces between the first and second rollers 100 and 102, the pins 86, and the blades 72 are provided by rolling contacts. The loads produced by both the aerodynamic forces and the centrifugal forces acting on the blades 72 is reacted through these rolling contacts between the generally cylindrical first and second rollers 100 and 102, the generally arcuate first and second grooves 96 and 98 of the pins 86, and the generally arcuate second face portions of the roots 82. These rolling contacts substantially minimize or eliminate scuffing, and thus substantially prevent catastrophic failure of the joints between the blades 72 and the turbine wheel 68.

Numerous modifications and alternative embodiments of the present invention will be apparent to those skilled in the art in view of the foregoing description. For example, instead of the groove 76 being continuous around the outer perimeter 74 of the turbine wheel 68, the groove 76 may comprise a plurality of individual groove segments which are recessed into the turbine wheel 68 through its outer perimeter 74, wherein each such individual groove segment corresponds to a root 82 of a blade 72. Two pins 82 and a corresponding pair of ceramic first and second rollers 100 and 102 would then be provided for each blade 72. Accordingly, the above description is to be construed as illustrative only and is for the purpose of teaching those skilled in the art the best mode of carrying out the present invention. The details of the structure may be varied substantially without departing from the spirit of the present invention, and the exclusive use of all modifications which come within the scope of the dependent claims is reserved.

I claim:

1. A turbine assembly comprising:

a turbine wheel;

a plurality of blades; and, attaching means for attaching the plurality of blades to the turbine wheel, the attaching means including a plurality of pins and a plurality of rollers, each of the rollers providing a rolling contact between a corresponding blade and a corresponding pin.

2. The turbine assembly of claim 1 wherein each pin is arranged between an adjacent pair of blades, wherein each pin has first and second rollers, wherein the first roller provides a rolling contact between its corresponding pin and one blade of the adjacent pair of blades, and wherein the second roller provides a rolling contact between its corresponding pin and the other blade of the adjacent pair of blades.

3. The turbine assembly of claim 2 wherein the blades, the pins, and the rollers are ceramic.

4. The turbine assembly of claim 1 wherein the blades, the pins, and the rollers are ceramic.

5. The turbine assembly of claim 1 wherein each pin has first and second ends and at least one groove, wherein the at least one groove of each pin extends along a surface thereof between the first and second ends but does not reach the first and second ends.

6. The turbine assembly of claim 1 wherein each pin has first and second ends and a pair of grooves, wherein each groove of the pair of grooves of each pin extends along a surface of its corresponding pin between the first and second ends but does not reach the first and second ends, wherein each pin is arranged between an adjacent pair of blades, wherein each pin has a first roller in one of its grooves, wherein each pin has a second roller in the other of its grooves, wherein the first roller provides a rolling contact between its corresponding pin and one of the adjacent pair of blades, and wherein the second roller provides a rolling contact between its corresponding pin and the other of the adjacent pair of blades.

7. A turbine assembly comprising:

an annular turbine wheel having a preestablished rate of thermal expansion, having an outer perimeter, and having a groove therein, the groove extending into the outer perimeter of the annular turbine wheel so as to form first and second end walls defining the groove, the first and second end walls having axially aligned holes therethrough;

a plurality of blades, each of the plurality of blades having a preestablished rate of thermal expansion which is less than the preestablished rate of thermal expansion of the annular turbine wheel, each of the plurality of blades having a root portion extending into the groove, the root portion of each blade having first and second opposing generally arcuate faces;

a plurality of pins, each of the plurality of pins having a preestablished rate of thermal expansion which is substantially equal to the preestablished rate of thermal expansion of the plurality of blades, the pins having grooves along surfaces thereof, and each pin extending through a corresponding pair of axially aligned holes; and, a plurality of rollers, each of the plurality of rollers having a preestablished rate of thermal expansion which is substantially equal to the preestablished rate of thermal expansion of the plurality of blades, each roller being positioned in a corresponding groove of a corresponding pin so that the pins and rollers retain the plurality of blades on the annular turbine wheel and so as to provide a rolling contact between the generally arcuate faces of the plurality of blades and the plurality of pins.

8. The turbine assembly of claim 7 wherein the groove extending into the annular turbine wheel is continuous, wherein each pin is arranged between the root portions of an adjacent pair of blades, and wherein each of the grooves of each pin has a roller therein to provide a rolling contact between each pin and the root portions of the adjacent pair of blades corresponding to each pin.

9. The turbine assembly of claim 8 wherein each of the first and second opposing generally arcuate faces of the root portions of each blade has first and second face portions, the first face portion of each root portion having a first radius and the second face portion of each root portion having a second radius, each roller being positioned between a corresponding second face portion and a corresponding pin.

10. The turbine assembly of claim 9 wherein the first radius is greater than the second radius.

11. The turbine assembly of claim 10 wherein the blades, the pins, and the rollers are ceramic.

12. The turbine assembly of claim 7 wherein the blades, the pins, and the rollers are ceramic.

13. The turbine assembly of claim 7 wherein each pin has first and second ends, wherein each groove of each pin extends along a surface thereof between the first and second ends of the corresponding pin but does not reach the first and second ends of the corresponding pin.

14. The turbine assembly of claim 13 wherein the groove extending into the annular turbine wheel is continuous, wherein each pin is arranged between the root portions of an adjacent pair of blades, and wherein each of the grooves of each pin has a roller therein to provide a rolling contact between each pin and the root portions of the adjacent pair of blades corresponding to each pin.

15. The turbine assembly of claim 14 wherein each of the first and second opposing generally arcuate faces of the root portions of each blade has first and second face portions, the first face portion of each root portion having a first radius and the second face portion of each root portion having a second radius, each roller being positioned between a corresponding second face portion and a corresponding pin.

16. The turbine assembly of claim 15 wherein the first radius is greater than the second radius.

17. The turbine assembly of claim 16 wherein the blades, the pins, and the rollers are ceramic.

18. A turbine assembly comprising:

a metal turbine wheel;

a plurality of ceramic blades, each ceramic blade having first and second ends, each second end having first and second opposing arcuate faces;

a plurality of ceramic pins, each ceramic pin having a pair of grooves along a surface thereof; and, a plurality of ceramic rollers, each ceramic roller being positioned in a corresponding groove of a corresponding ceramic pin so that the plurality of ceramic rollers and the plurality of ceramic pins retain the plurality of ceramic blades attached to the metal turbine wheel and so that a rolling contact is provided between the arcuate faces of the second ends of the plurality of ceramic blades and the plurality of ceramic pins.

19. The turbine assembly of claim 18 wherein each ceramic pin is arranged between the second ends of an adjacent pair of ceramic blades, and wherein each groove of each ceramic pin has a ceramic roller therein to provide a rolling contact between its ceramic pin and the second end of a corresponding ceramic blade.

20. The turbine assembly of claim 19 wherein each of the first and second opposing arcuate faces of each ceramic blade has first and second face portions, the first face portion of each ceramic blade having a first radius and the second face portion of each ceramic blade having a second radius, each ceramic roller being positioned between a corresponding second face portion and a corresponding ceramic pin.

21. The turbine assembly of claim 20 wherein the first radius is greater than the second radius.

22. The turbine assembly of claim 18 wherein each ceramic pin has first and second ends, wherein each groove of each ceramic pin extends along a surface thereof between the first and second ends but does not reach the first and second ends.

23. The turbine assembly of claim 22 wherein each ceramic pin is arranged between the second ends of an adjacent pair of ceramic blades, and wherein each groove of each ceramic pin has a ceramic roller therein to provide a rolling contact between each ceramic pin and the second ends of the adjacent pair of ceramic blades corresponding to each ceramic pin.

24. The turbine assembly of claim 23 wherein each of the first and second opposing arcuate faces of each ceramic blade has first and second face portions, the first face portion of each ceramic blade having a first radius and the second face portion of each ceramic blade having a second radius, and each ceramic roller being positioned between a corresponding second face portion and a corresponding ceramic pin.

25. The turbine assembly of claim 24 wherein the first radius is greater than the second radius.

* * * * *